US006242854B1

(12) United States Patent
Yamamoto et al.

(10) Patent No.: US 6,242,854 B1
(45) Date of Patent: Jun. 5, 2001

(54) INDIRECTLY HEATED CATHODE FOR A CRT HAVING HIGH PURITY ALUMINA INSULATING LAYER WITH LIMITED AMOUNTS OF NA OR SI

(75) Inventors: Yoji Yamamoto, Hyogo; Masaki Kawasaki; Hideo Koshino, both of Osaka; Junya Nakai, Kyoto; Tetsuya Shimizu, Kyoto, all of (JP)

(73) Assignee: Matsushita Electronics Corporation, Osaka (JP)

( * ) Notice: Subject to any disclaimer, the term of this patent is extended or adjusted under 35 U.S.C. 154(b) by 0 days.

(21) Appl. No.: 09/228,252

(22) Filed: Jan. 11, 1999

(30) Foreign Application Priority Data

Jan. 20, 1998 (JP) ..... 10-008304

(51) Int. Cl.[7] ..... H01J 1/14; H01J 19/06; H01J 17/12; H01J 19/38; H01K 1/04

(52) U.S. Cl. ..... 313/346 R; 313/346 DC; 313/350; 313/353; 313/354; 313/355; 313/356; 313/351

(58) Field of Search ..... 313/346 R, 346 DC, 313/347, 348, 349, 350, 352, 353, 354, 355, 356, 409, 410, 411, 441, 446, 450, 456–458

(56) References Cited

U.S. PATENT DOCUMENTS 4,844,942 7/1989 Koizumi et al. .

FOREIGN PATENT DOCUMENTS 617879 3/1949 (GB) .
802731 10/1958 (GB) .
44-1775 1/1969 (JP) .
53-1458 1/1978 (JP) .
59-200798 11/1984 (JP) .
60-221925 11/1985 (JP) .
62-378442 2/1987 (JP) .
1-31825 2/1989 (JP) .
1-71032 3/1989 (JP) .
2-276128 11/1990 (JP) .
4-127022 4/1992 (JP) .
7-220617 8/1995 (JP) .

OTHER PUBLICATIONS

Apr. 16, 1999 Communication form European Patent Office and attached Search Report for Application No. 98123753.0–1240–.

May 11, 1999 Communication from European Patent Office and attached Search Report for Application No. 99100604.0–2208–.

*Primary Examiner*—Ashok Patel
*Assistant Examiner*—Mack Haynes
(74) *Attorney, Agent, or Firm*—Merchant & Gould P.C.

(57) ABSTRACT

In an indirectly heated cathode comprising a heater having an alumina electrical insulating layer formed by layering and sintering alumina particles on a surface of a metal wire and an electron-emitting part that receives heat from the heater and emits thermoelectrons, and a cathode-ray tube comprising the indirectly heated cathode, the alumina particles contained in the alumina electrical insulating layer have a purity of at least 99.7 wt % and the alumina particles used for forming the alumina electrical insulating layer have a Na content of 20 ppm or less or a Si content of 100 ppm or less, thus enabling stable production, avoiding the occurrence of cracks in the alumina electrical insulating layer and heater deformation even in the practical operation of the cathode-ray tube, and lengthening the life of the heater.

24 Claims, 10 Drawing Sheets

INDIRECTLY HEATED CATHODE FOR A CRT HAVING HIGH PURITY ALUMINA INSULATING LAYER WITH LIMITED AMOUNTS OF NA OR SI

FIELD OF THE INVENTION

The present invention relates to an indirectly heated cathode for a cathode-ray tube used for a television receiver, a computer display, or the like and to a cathode-ray tube comprising the same. Particularly, the present invention relates to an alumina electrical insulating layer of a heater for an indirectly heated cathode used in an electron gun.

BACKGROUND OF THE INVENTION

FIG. 10 shows a heater 13 used for a conventional general indirectly heated cathode. In FIG. 10, an alumina electrical insulating layer 11 is formed by layering alumina particles on a surface of a metal-wire coil 14 by electrophoresis, spraying, or the like and then sintering it. The metal-wire coil 14 is made of tungsten or rhenium-tungsten alloy and is coiled. A metal cap 17 and a sleeve 10 for holding a cathode 9 are provided outside the heater 13. The heater 13 supplies a sufficient amount of heat to the metal cap 17 and the sleeve 10 so that the cathode 9 emits thermoelectrons. The alumina electrical insulating layer 11 on the surface of the metal-wire coil 14 maintains the electric insulation between the sleeve 10 and the metal-wire coil 14. Further, a dark layer 12 made of a mixture of tungsten-alumina particles and alumina particles is provided on the alumina electrical insulating layer 11, thus increasing the heat transfer efficiency from the heater 13 to the sleeve 10.

However, in an indirectly heated cathode provided with a heater having such an alumina electrical insulating layer, thermal stress is concentrated at uneven parts in the alumina electrical insulating layer during sintering and the practical operation. As a result, cracks 16 and deformation of the heater occur easily, thus causing decrease in volume of heat-transfer to a cathode, increase in heater temperature, bad electrical insulation between the heater and the cathode, heater breakdown, or the like. In addition, the operation temperature of the cathode decreases and therefore electron emission decreases, thus affecting the characteristics of a cathode-ray tube.

In order to solve such problems, various methods have been proposed. For instance, there are methods in which an alumina electrical insulating layer is strengthened by mixing a fibrous or whisker-like high-melting inorganic insulator with an inorganic insulator, thus preventing cracks (Japanese Patent Gazette Tokko Sho 44-1775) and on the contrary, porosity in an alumina electrical insulating layer is increased, thus preventing cracks from progressing (Publication of Unexamined Japanese Patent Application Tokkai Sho 60-221925).

However, in the conventional methods mentioned above, there were problems that materials were expensive and when increasing the porosity it was difficult to obtain a uniform alumina electrical insulating layer, thus significantly affecting the defective percentage in manufacturing a heater or damage on a heater after being incorporated into a cathode. Both above-mentioned methods were effective for a heater operated at relatively low temperature (about 1100° C. or less) but caused a short life of a heater operated at high temperature (at least about 1100° C.), for example, in an impregnated cathode.

SUMMARY OF THE INVENTION

In order to solve the conventional problems described above, the present invention aims to provide an indirectly heated cathode that can be produced stably and avoids the occurrence of cracks in an alumina electrical insulating layer, heater deformation, and the like even in the practical operation of a cathode-ray tube, thus lengthening the life of a heater. The present invention also aims to provide a cathode-ray tube comprising the indirectly heated cathode.

In order to attain the object described above, an indirectly heated cathode of the present invention comprises a heater and an electron-emitting part. The heater has an alumina electrical insulating layer formed by layering and sintering alumina particles on a surface of a metal wire. The electron-emitting part receives heat from the heater and emits thermoelectrons. The indirectly heated cathode is characterized in that alumina particles contained in the alumina electrical insulating layer have a purity of at least 99.7 wt % and alumina particles with a particle size of 2 $\mu$m or less included in the alumina particles used for forming the alumina electrical insulating layer have a Na content of 20 ppm or less or the alumina particles used for forming the alumina electrical insulating layer have a Si content of 100 ppm or less.

The cathode-ray tube of the present invention comprises a face plate having a phosphor screen on its inner surface, a funnel portion connected to the rear of the face plate, and a neck portion formed at the rear of the funnel portion. In the neck portion, an electron gun that emits electron beams is provided. In the cathode-ray tube, an indirectly heated cathode in the electron gun comprises a heater and an electron-emitting part. The heater has an alumina electrical insulating layer formed by layering and sintering alumina particles on a surface of a metal wire. The electron-emitting part receives heat from the heater and emits thermoelectrons. The indirectly heated cathode is characterized in that alumina particles contained in the alumina electrical insulating layer have a purity of at least 99.7 wt % and alumina particles with a particle size of 2 $\mu$m or less included in the alumina particles used for forming the alumina electrical insulating layer have a Na content of 20 ppm or less or the alumina particles used for forming the alumina electrical insulating layer have a Si content of 100 ppm or less.

In the indirectly heated cathode and the cathode-ray tube of the present invention, it is preferable that the alumina particles with a particle size of 2 $\mu$m or less are included in the alumina particles as a whole used for forming the electrical insulating layer in a ratio of 10–50 wt %. The life of the heater can be further lengthened by defining the particle size of the alumina particles and the Na content.

In the indirectly heated cathode and the cathode-ray tube of the present invention, it is preferable that the electron-emitting part is made of an oxide cathode material. When using the oxide cathode material, the electron-emitting part is suitable for an indirectly heated cathode operated at relatively low temperature. The oxide cathode material is effective especially when the alumina particles with a particle size of 2 $\mu$m or less are included in the alumina particles as a whole in a ratio of 10–50 wt %.

Further, in the indirectly heated cathode and the cathode-ray tube of the present invention, it is preferable that the alumina particles with a particle size of 2 $\mu$m or less, those with a particle size of 5–20 $\mu$m, and those with a particle size above 20 $\mu$m are included in the alumina particles as a whole in a ratio of 10–40 wt %, 40–70 wt %, and 10 wt % or less, respectively.

In the indirectly heated cathode and the cathode-ray tube of the present invention, it is preferable that the electron-emitting part is made of an impregnated cathode material.

The impregnated cathode material is effective especially when the alumina particles with a particle size of 2 μm or less, those with a particle size of 5–20 μm, and those with a particle size above 20 μm are included in the alumina particles as a whole in a ratio of 10–40 wt %, 40–70 wt %, and 10 wt % or less, respectively.

In the indirectly heated cathode and the cathode-ray tube of the present invention, it is preferable that all the alumina particles used for forming the electrical insulating layer have a Na content of 20 ppm or less.

In the indirectly heated cathode and the cathode-ray tube of the present invention, it is also preferable that a dark layer made of a mixture of tungsten-alumina particles and alumina particles is further formed on the alumina electrical insulating layer.

In the indirectly heated cathode and the cathode-ray tube of the present invention, it is preferable that the metal wire is made of tungsten-rhenium alloy.

In the indirectly heated cathode and the cathode-ray tube of the present invention, it is preferable that the alumina electrical insulating layer has a thickness in a range of 40–150 μm.

Furthermore, in the indirectly heated cathode and the cathode-ray tube of the present invention, it is preferable that the dark layer has a thickness in a range of 0.5–5 μm.

DETAILED DESCRIPTION OF THE INVENTION

According to experiments conducted by the inventors, there are two significant factors affecting the life of an alumina electrical insulating layer. The first factor is a Na content in alumina particles and the second factor is size distribution of the alumina particles. The reasons can be explained as follows.

During sintering, Na evaporates to some extent, but the presence of Na on surfaces of the alumina particles deteriorates the degree of sintering, thus forming weak sintered portions with low flexibility. This becomes significant as the Na content increases. On the other hand, minute alumina particles with a particle size of 2 μm or less have a larger specific surface area than that of rough alumina particles and therefore have many contact points within a formed alumina electrical insulating layer. Thus, when increasing the minute alumina particles, the strength of the alumina electrical insulating layer is increased apparently. On the other hand, however, it means that when the minute alumina particles have a large Na content, many weak sintered portions as described above are formed accordingly. Thermal stress during repeated operations causes cracks that start occurring from a weaker portion sequentially. Therefore, in this case it can be conceived that there are many sintered portions where cracks occur easily, thus causing cracks and deformation easily at an early stage. Consequently, the Na content in the alumina particles should be as small as possible.

With respect to particle size distribution, generally particles are classified crudely into large or small particles, or large, middle, or small particles and the size distribution of particles in each classification has a peak. Even if the Na content is small, too many minute alumina particles result in too high density after sintering. As a result, thermal expansion of a metal-wire coil as a base metal can not be absorbed and therefore cracks occur easily. Consequently, it is also desirable to limit the ratio of small alumina particles.

Thus, in the present invention, the Na content in alumina particles is defined within a specific range and the size distribution of the alumina particles is then defined within a specific range.

EMBODIMENT 1

An embodiment 1 of the present invention will be explained with reference to the drawings as follows.

Figure 1:
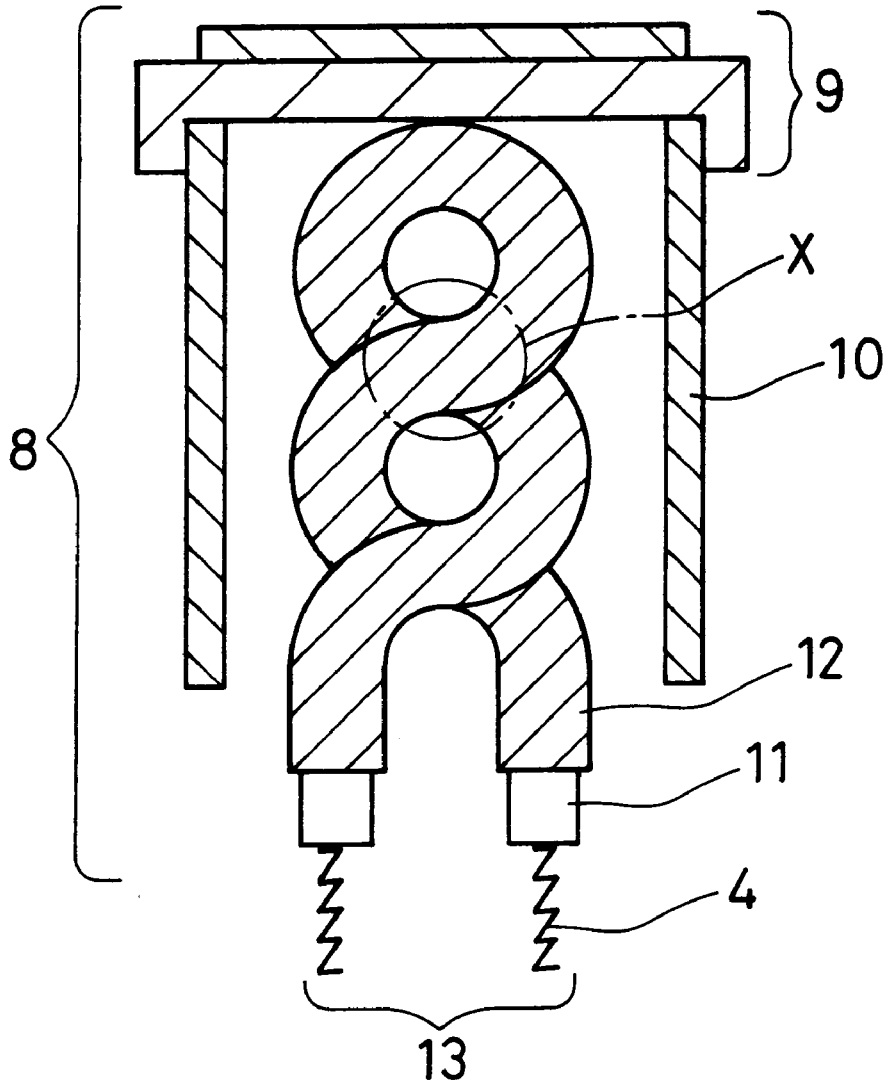
FIG. 1 shows a partial cross-sectional view showing an indirectly heated cathode of an embodiment according to the present invention.
Figure 2:
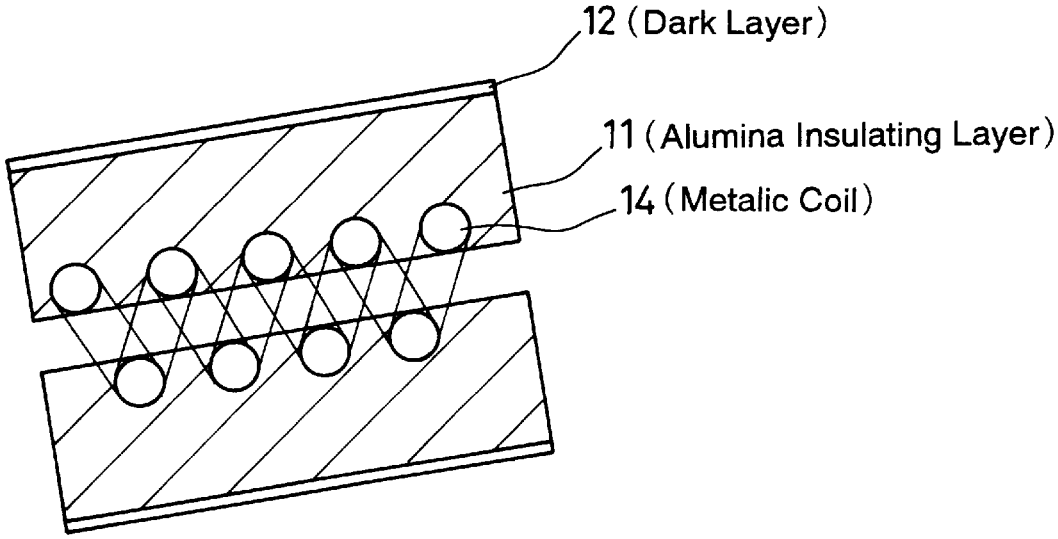
FIG. 2 is an enlarged view of a portion X in FIG. 1.

As shown in FIG. 1, an indirectly heated cathode 8 comprises a cathode 9 (an electron-emitting part) at one end and a coiled heater 13 (a heater part). The cathode 9 is formed of an emitter for emitting electrons. The heater 13 has an alumina electrical insulating layer 11 on a metal-wire coil 14 (a base metal) and a dark layer 12 on the alumina electrical insulating layer 11 inside a sleeve 10. FIG. 2 is an enlarged view of a portion X in FIG. 1.

The alumina electrical insulating layer 11 is formed of alumina particles. Each alumina particle has a purity of at least 99.7 wt % or the alumina particles as a whole have a purity of at least 99.7 wt %. For alumina particles with a particle size of 2 μm or less included in the alumina particles mentioned above, each alumina particle or the alumina particles as a whole have a Na content of 20 ppm or less. The alumina particles with a particle size of 2 μm or less are included in a ratio of 10–40 wt % in the alumina particles as a whole.

Further, it is preferable that alumina particles with a particle size of 5–20 μm and those with a particle size above 20 μm are included in a ratio of 40–70 wt % and 10 wt % or less, respectively. It is also preferable that each alumina particle or the alumina particles as a whole have a Na content of 20 ppm or less.

The reason for defining the composition of the alumina particles in the above-mentioned numerical range will be explained as follows.

Figure 10:
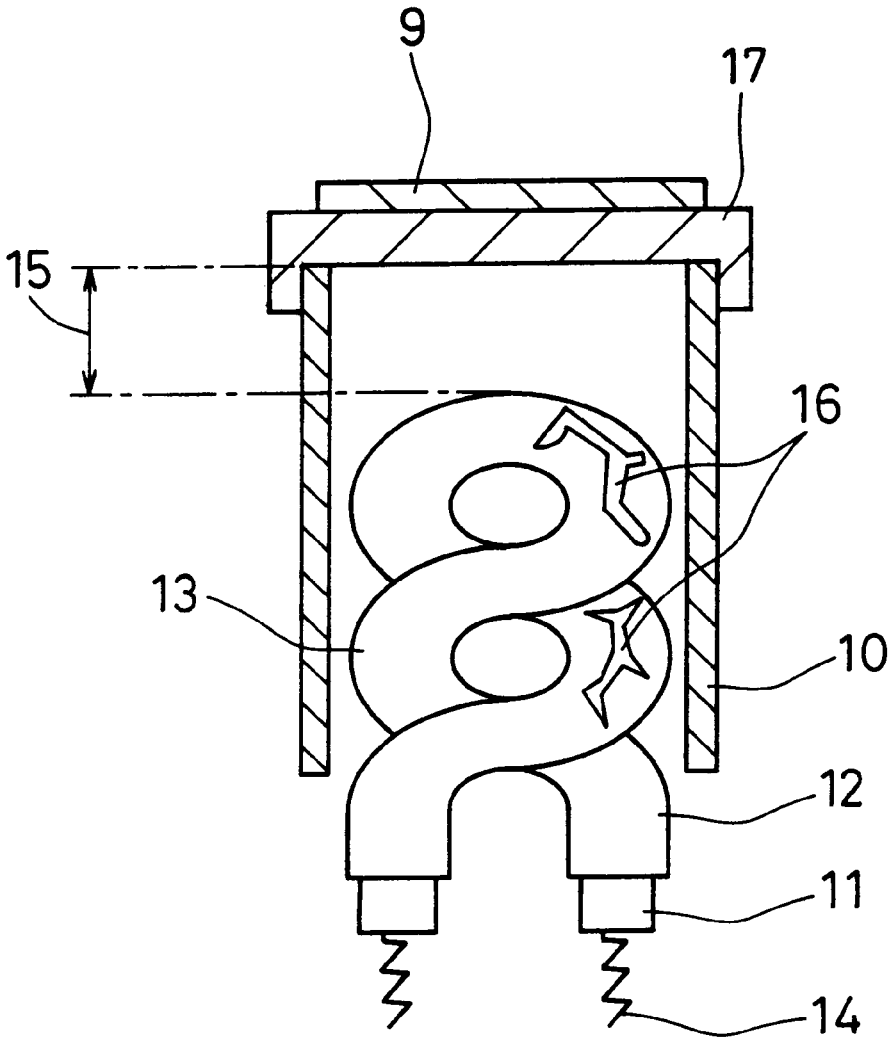
FIG. 10 (PRIOR ART)
FIG. 10 is a partial cross-sectional view of a conventional indirectly heated cathode.

Generally, in the heater 13 to be incorporated into the indirectly heated cathode 8, when a heating operation is repeated, cracks 16 occur at the weakest portions in the alumina electrical insulating layer due to expansion and thermal stress of the heater as shown in FIG. 10. In addition, the heater 13 is deformed and shortened by a volume 15 of heater deformation compared to that before repeating the heating operation (FIG. 1). As a result, bad electrical insulation and variation in heater temperature due to heater current fluctuation are caused, which leads to variation in cathode temperature. The variation in cathode temperature causes a deficiency in electron-emission, resulting in decrease in brightness or the like of a cathode-ray tube.

The inventors found from the following experiments that the main factor of such phenomena was not the general purity of the alumina particles but the Na content as well as the particle size distribution in the alumina electrical insulating layer.

First, in an oxide cathode that operates at relatively low temperature (heater temperature at the time of practical operations: about 1050° C.), the influence of the particle size distribution and the Na content on the volume of heater deformation was examined. The results will be explained as follows.

The oxide cathode was formed by the application, spray or the like of an electron-emissive material (an emitter) consisting of BaO, SrO, CaO, or the like onto a base metal (a metal substrate) in which small amounts of reducing elements were added to the main component of Ni or the like, so that the emissive material adheres onto the base metal.

Alumina particles used for the experiment included minute alumina particles with a particle size of 2 μm or less and alumina particles with a particle size above 2 μm. The minute alumina particles had a purity of 99.7 wt % and a Na content of 20 ppm, or a purity of 99.9 wt % and a Na content of 100 ppm. The alumina particles with a particle size above 2 μm had a middle particle-size of about 6 μm (distributed mainly in a range of 2–15 μm), a purity of 99.9 wt %, and a Na content of 100 ppm, or a middle particle-size of about 6 μm (distributed mainly in a range of 2–15 μm), a purity of 99.7 wt %, and a Na content of 20 ppm. The alumina particles as a whole had a Si content of 50 ppm.

Figure 3:
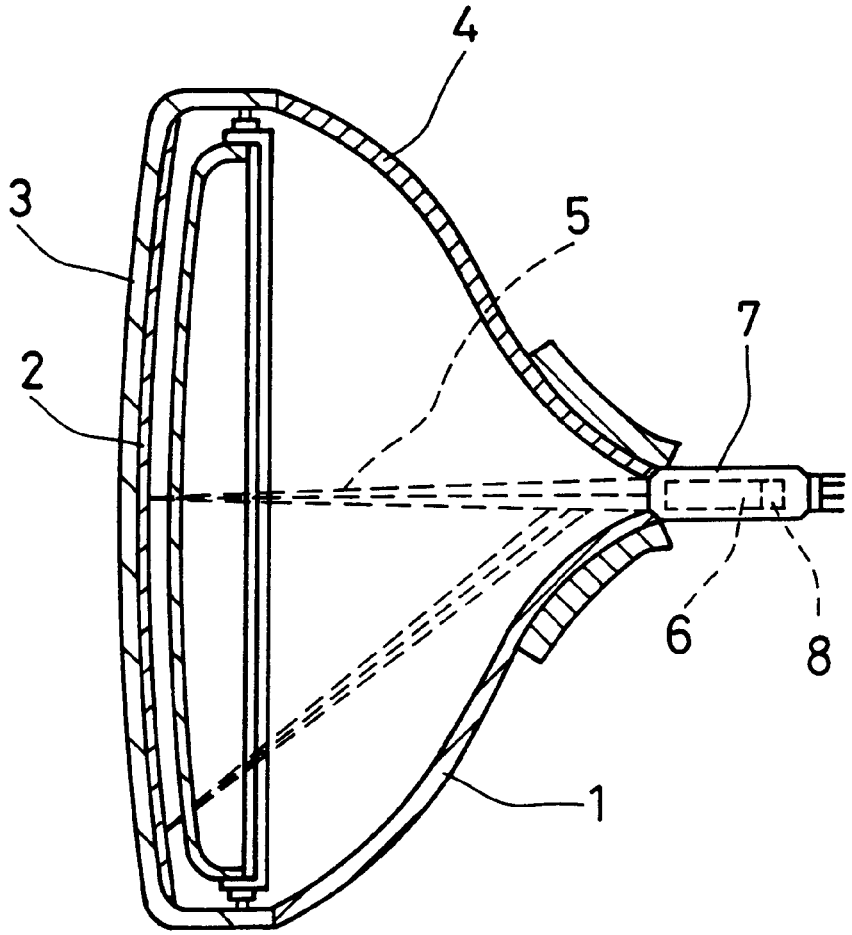
FIG. 3 is a cross-sectional view of a cathode-ray tube comprising an indirectly heated cathode of the above embodiment according to the present invention.

FIG. 3 shows a cathode-ray tube used in an embodiment 1 of the present invention. The cathode-ray tube 1 comprises a face plate 3 having a phosphor screen 2 on its inner surface, a funnel portion 4 attached at the rear of the face plate 3, and a neck portion 7 formed at the rear of the funnel portion 4. An electron gun 6 for emitting electron beams 5 is provided inside the neck portion 7. An indirectly heated cathode 8 is provided at an end of the electron gun 6.

Next, a concrete method of manufacturing a heater according to the present invention will be described.

Alumina particles were mixed suitably so as to have a desired ratio. Then, 500 ml of a solution including 10 wt % of polyvinyl acetate (PVAc) as binder, 100 ml of a rosin solution including 10 wt % of rosin as surfactant, and a proper amount of a solution including 9 wt % of copper nitrate as electrolyte were added to a mixture of 1 kg of the mixed alumina particles and 3000 ml of methanol, thus preparing a suspension for electrodeposition.

Next, a metal-wire coil formed by winding tungsten-rhenium in a coil shape was used as a negative electrode and was dipped into a coating bath filled with the suspension for electrodeposition together with a positive electrode made of platinum. A voltage of 70–120V was applied between the electrodes and an alumina electrical insulating layer was electrodeposited onto the metal-wire coil so as to have a thickness of 40–150 μm.

Further, a dark layer formed of a mixture of tungsten particles and alumina particles was applied onto the alumina electrical insulating layer. After that, it was sintered in an atmosphere of hydrogen at about 1600° C., and then a molybdenum wire used as a core of the metallic coil wire was melted, thus obtaining a heater. After the sintering, the alumina electrical insulating layer had a thickness in a range of 40–150 μm and the dark layer had a thickness in a range of 0.5–5 μm.

Heaters having an alumina electrical insulating layer were manufactured under the following respective conditions about the alumina particles with a particle size of 2 μm or less. Indirectly heated cathodes comprising the respective heaters were incorporated into cathode-ray tubes. In each cathode-ray tube, a forced heat cycle experiment was carried out by applying a voltage of about 8V (about 1.3 times of voltage at the time of practical operations) to the heater repeatedly.

Figure 4:
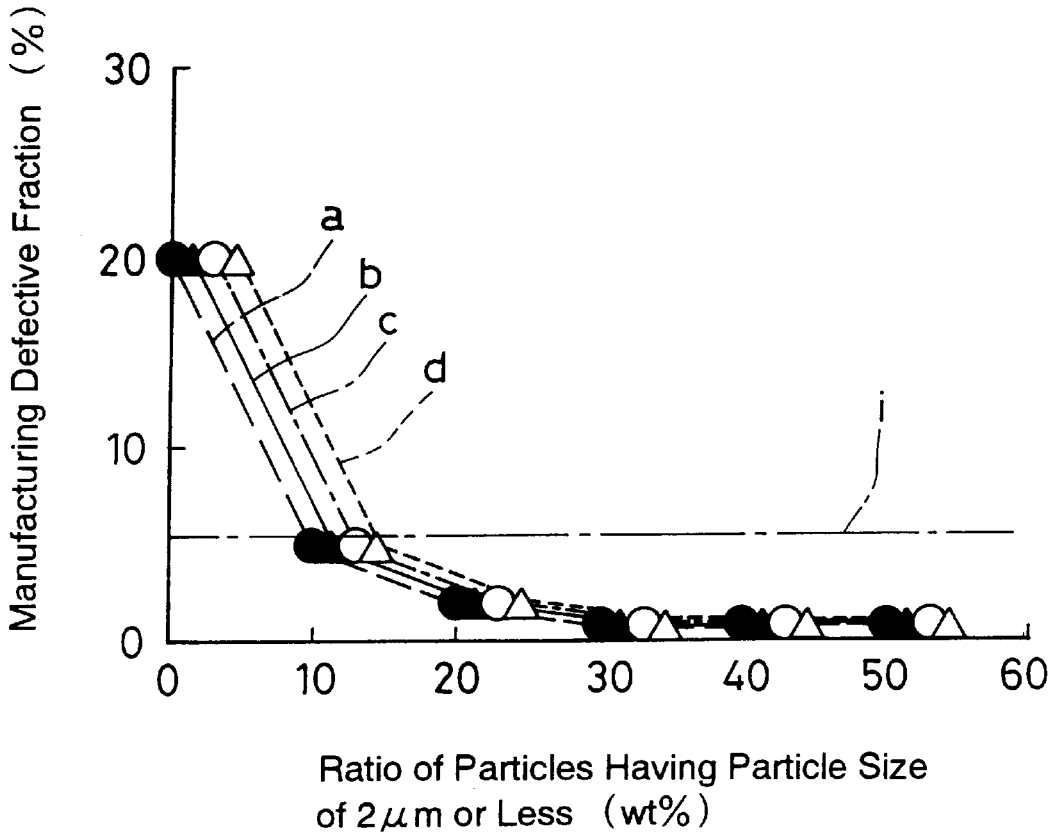
FIG. 4 is a graph showing the relationship between a manufacturing defective percentage and a ratio of alumina particles having a particle size of 2 μm or less in an oxide cathode of the above embodiment according to the present invention.

FIG. 4 shows the relationship between a ratio of alumina particles with a particle size of 2 μm or less and a manufacturing defective percentage. In FIG. 4, a mark ●(a curved line a) indicates the case where the alumina particles with a particle size of 2 μm or less have a Na content of 100 ppm and alumina particles with a particle size above 2 μm have a Na content of 100 ppm. Similarly, a mark ▲(a curved line b) indicates the case where the alumina particles with a particle size of 2 μm or less and those with a particle size above 2 μm have a Na content of 100 ppm and 20 ppm, respectively. A mark ○(a curved line c) indicates the case where the alumina particles with a particle size of 2 μm or less and those with a particle size above 2 μm have a Na content of 20 ppm and 100 ppm, respectively, and a mark Δ(a curved line d) indicates the case where both the alumina particles with a particle size of 2 μm or less and those with a particle size above 2 μm have a Na content of 20 ppm. A straight line indicates a boundary line that shows a manufacturing defective percentage of 5%. The allowable range of the manufacturing defective percentage is shown below the line i.

As shown in FIG. 4, when the minute alumina particles with a particle size of 2 μm or less are contained in an alumina electrical insulating layer in a ratio below 10 wt % in any cases described above, formability of the alumina electrical insulating layer is deteriorated, resulting in extremely high manufacturing defective percentage. Thus, it was found that in view of the productivity preferably the alumina particles with a particle size of 2 μm or less were present in a ratio of at least 10 wt %.

Figure 5:
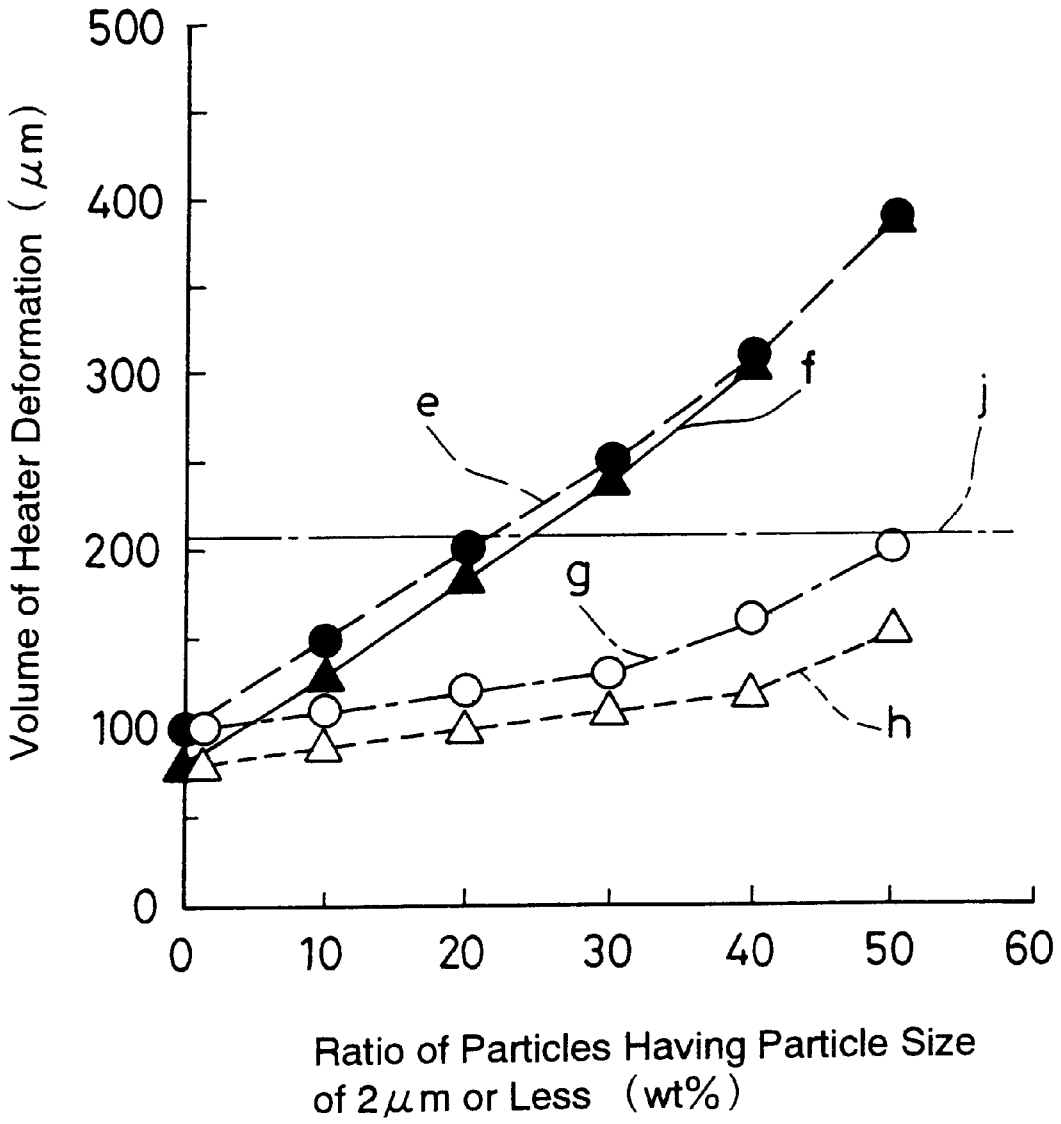
FIG. 5 is a graph showing the relationship between a volume of heater deformation and a ratio of alumina particles having a particle size of 2 μm or less in the above embodiment of the present invention.

FIG. 5 shows the relationship between a ratio of alumina particles with a particle size of 2 μm or less and a volume of heater deformation (a volume 15 of heater deformation in FIG. 10). Marks ●(a curved line e), ▲(a curved line f), ○(a curved line g), and Δ(a curved line h) show experimental results under the same conditions as those for the respective marks in FIG. 4. A straight line j indicates a boundary line that shows a volume of heater deformation of 200 μm. When the deformation volume is shown above the line j, it indicates "defective".

As shown with the curved lines e–h in FIG. 5, when the alumina particles with a particle size of 2 μm or less have a Na content of 20 ppm, the volume of heater deformation is small and therefore good results can be obtained. On the other hand, the Na content in the alumina particles with a particle size above 2 μm has nothing to do with the volume of heater deformation. However, when the ratio of the alumina particles with a particle size of 2 μm or less goes beyond 50 wt %, the volume of heater deformation reaches to the defective level (a level affecting the characteristics of a cathode-ray tube). Thus, it was found that in view of decreasing the volume of heater deformation, preferably the alumina particles with a particle size of 2 μm or less had a Na content of 20 ppm or less and were present in a ratio of 50 wt % or less. Further, when every alumina particle had a Na content of 20 ppm regardless of its particle size, the best result was obtained.

According to the experimental results described above, it was found that in the alumina electrical insulating layer of an oxide cathode, preferably the alumina particles with a particle size of 2 μm or less had a Na content of 20 ppm and were present in a ratio of 10–50 wt %. It is more preferable that every alumina particle has a Na content of 20 ppm or less.

Next, in an impregnated cathode that operates at relatively high temperature (heater temperature at the time of practical operations: about 1150° C.), the same experiment as that in the case of using the oxide cathode mentioned above was carried out. The results will be explained as follows.

The impregnated cathode was formed by melting and impregnating an electron-emissive material (emitter) such as BaO, CaO, and $Al_2O_3$ in pores of a porous high-melting substrate made of W, Mo, or the like and then layering a high-melting-metal thin film formed of, for example, Os—Ru and Ir on a surface of the substrate.

In the impregnated cathode, when using alumina particles with the same particle size as that in the oxide cathode described above as alumina particles with a particle size above 2 μm, relatively good productivity was obtained in the case of using alumina particles having a Na content of 20 ppm as alumina particles with a particle size of 2 μm or less. However, in view of the volume of heater deformation, satisfactory result was not obtained. When increasing the ratio of the alumina particles with a particle size above 20 μm, the formability of the alumina electrical insulating layer was greatly damaged.

Therefore, as the alumina particles with a particle size of 2 μm or less, the same alumina particles as those used for the oxide cathode described above were used, and at the same time, as the alumina particles with a particle size above 2 μm, alumina particles having a middle particle-size of about 10 μm (distributed mainly in a range of 5–20 μm), a purity of 99.9 wt %, and a Na content of 100 ppm, or alumina particles having a middle particle-size of about 10 μm (distributed mainly in a range of 5–20 μm), a purity of 99.7 wt %, and a Na content of 20 ppm were used. The alumina particles as a whole had a Si content of 50 ppm.

Figure 6:
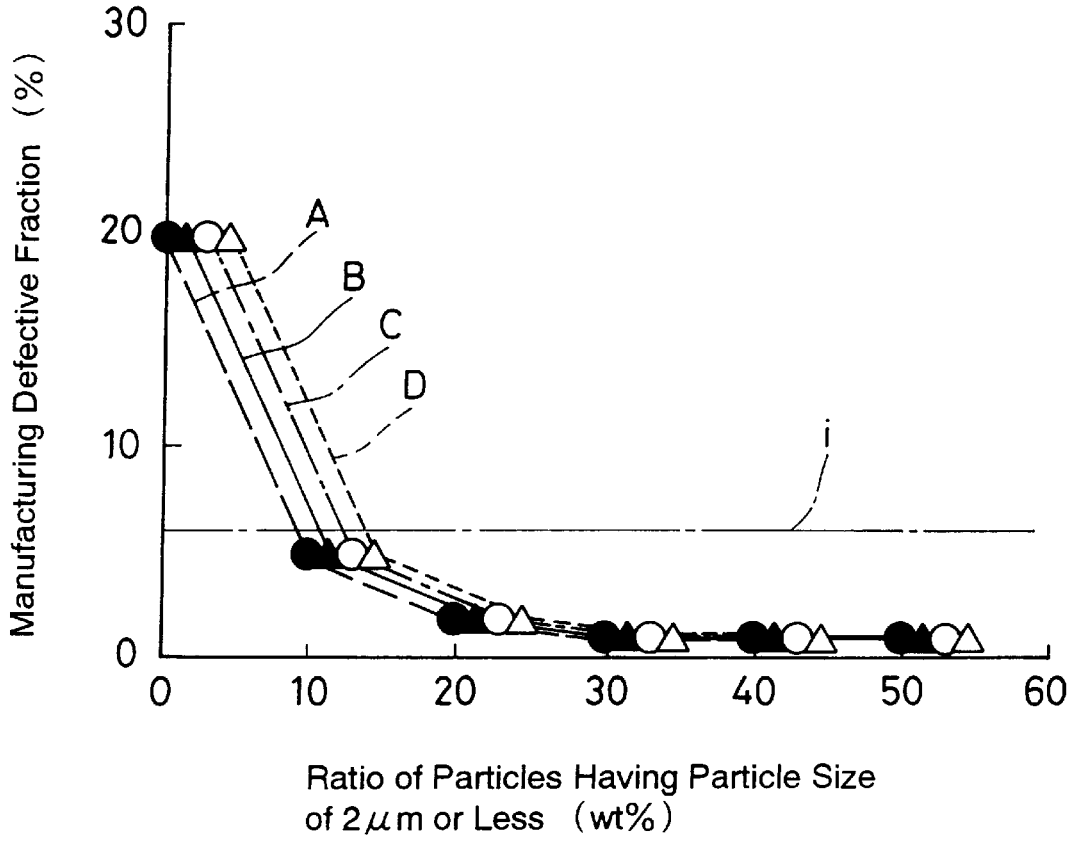
FIG. 6 is a graph showing the relationship between a manufacturing defective percentage and a ratio of alumina particles having a particle size of 2 μm or less in an impregnated cathode of the above embodiment according to the present invention.

FIG. 6 shows the relationship between a ratio of alumina particles with a particle size of 2 μm or less and a manufacturing defective percentage. Marks ●(a curved line A), ▲(a curved line B), ○(a curved line C), and Δ(a curved line D) show experimental results under the same conditions as in FIG. 4. A straight line indicates a boundary line that shows a manufacturing defective percentage of 5%.

As shown in FIG. 6, when the ratio of the alumina particles with a particle size of 2 μm or less contained in an alumina electrical insulating layer becomes below 10 wt %, the formability of the alumina electrical insulating layer is deteriorated as in the oxide cathode, resulting in an extremely high manufacturing defective percentage. Thus, it was found that in view of the productivity, preferably the ratio of the alumina particles with a particle size of 2 μm or less were present in a ratio of at least 10 wt %.

Figure 7:
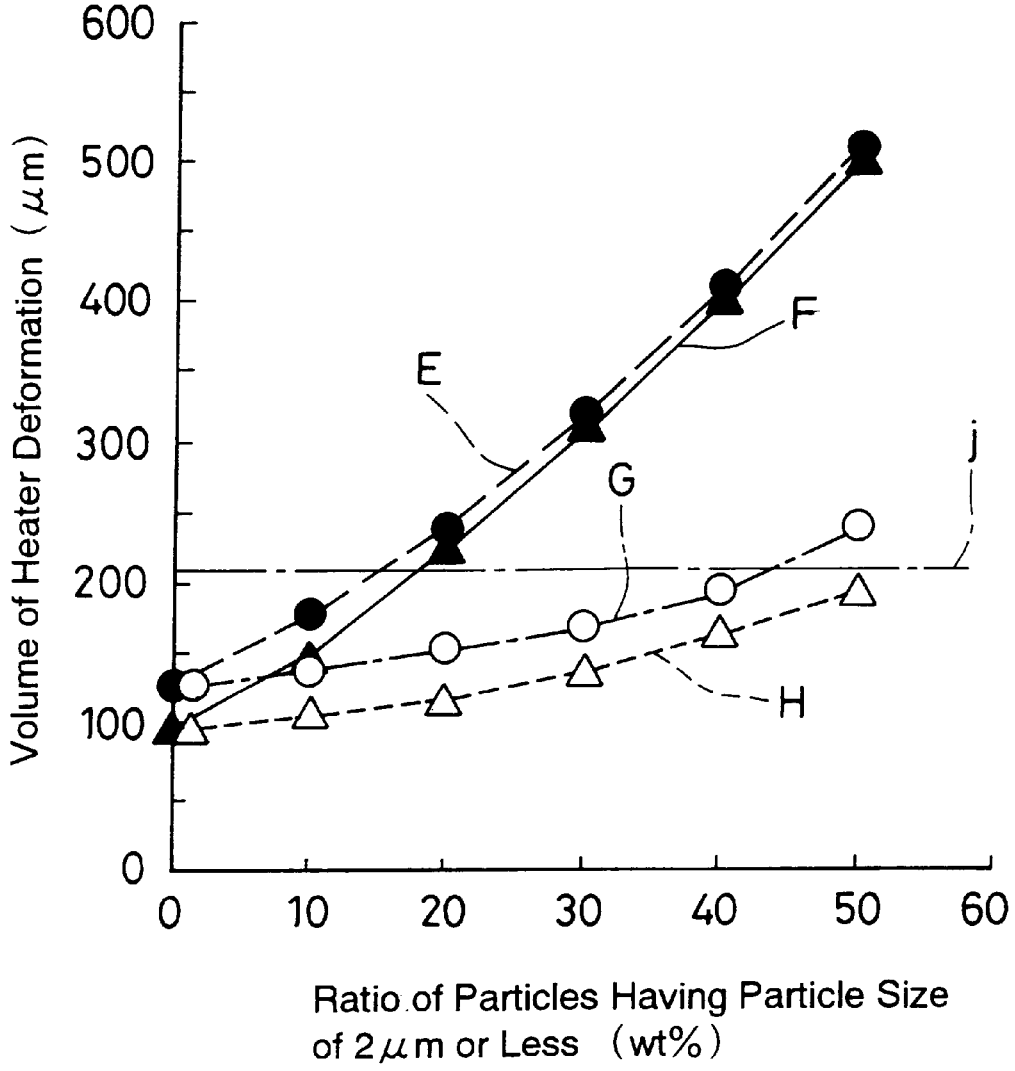
FIG. 7 is a graph showing the relationship between a volume of heater deformation and a ratio of alumina particles having a particle size of 2 μm or less in the above embodiment of the present invention.

FIG. 7 shows the relationship between a ratio of alumina particles with a particle size of 2 μm or less and a volume of heater deformation. Marks ●(a curved line E), ▲(a curved line F), ○(a curved line G), and Δ(a curved line H) show experimental results under the same conditions as those for the respective marks in FIG. 4. A straight line indicates a boundary line that shows a volume of heater deformation of 200 μm.

Similarly, with respect to the volume of heater deformation, as shown in FIG. 7, when the alumina particles with a particle size of 2 μm or less have a Na content of 20 ppm, the volume of heater deformation is small and therefore good results can be obtained as in the oxide cathode described above. On the other hand, the volume of heater deformation has nothing to do with the Na content in the alumina particles with a particle size above 2 μm. However, when the ratio of the alumina particles with a particle size of 2 μm or less goes beyond 40 wt %, the volume of heater deformation reaches the defective level (a level affecting the characteristics of a cathode-ray tube). Therefore, in view of decreasing the volume of heater deformation, it is preferable that the alumina particles with a particle size of 2 μm or less have a Na content of 20 ppm or less and are included in a ratio of 40 wt % or less. When every alumina particle had a Na content of 20 ppm, the best result was obtained regardless of its particle size.

In addition, the composition of alumina particles used in the case where the volume of heater deformation was in a good level and the manufacturing defective percentage was within 5% (within the allowable range in manufacturing) was examined. The alumina particles with a particle size of 5–20 μm were contained in the alumina electrical insulating layer in a ratio of 40–70 wt % and the alumina particles with a particle size above 20 μm were present in a ratio of 10 wt % or less.

According to the experimental results described above, it was found that in the alumina electrical insulating layer of an impregnated cathode, preferably the alumina particles with a particle size of 2 μm or less had a Na content of 20 ppm and were present in a ratio of 10–40 wt %, the alumina particles with a particle size of 5–20 μm were present in a ratio of 40–70 wt %, and the alumina particles with a particle size above 20 μm were present in a ratio of 10 wt % or less. It was more preferable that every alumina particle had a Na content of 20 ppm or less.

The inventors directed their attention to the point that Si content in alumina particles also was related to the factors that greatly affect the life of an alumina electrical insulating layer. The reason will be explained as follows.

Since Si hardly evaporates during sintering, Si has a different property from that of Na. However, the presence of Si on surfaces of alumina particles deteriorates the degree of sintering, thus forming weak sintered portions with low flexibility. Especially, this becomes significant as the Si content increases. In this point, Si affects the life of alumina electrical insulating layer as Na does.

Therefore, it also is preferred to define the Si content in alumina particles as low as possible. When defining the Na content, the attention was given to the particles with a particle size of 2 μm or less. However, when the Si content is defined by considering not the alumina particles with a particle size of 2 μm or less alone but the alumina particles as a whole, a greater effect can be obtained.

Thus, in the present invention the Si content in the alumina particles as a whole was defined in a specific range.

EMBODIMENT 2

A second embodiment of the present invention will be described as follows.

In an indirectly heated cathode according to this embodiment, an alumina electrical insulating layer is formed of alumina particles. Each alumina particle has a purity of at least 99.7 wt % or the alumina particles as a whole have a purity of at least 99.7 wt %. Each alumina particle or the alumina particles as a whole have a Si content of 100 ppm or less. Alumina particles with a particle size of 2 μm or less are included in the alumina particles as a whole in a ratio of 10–40 wt %.

It is preferable that alumina particles with a particle size of 5–20 μm are included in a ratio of 40–70 wt % and the alumina particles with a particle size above 20 μm are included in a ratio of at least 10 wt %.

According to the following experiment, the inventors found that it was necessary to define the size distribution of alumina particles in the alumina electrical insulating layer and the Si content in the alumina particles within the numerical range described above.

In an indirectly heated cathode having an electron-emitting part made of an impregnated cathode material, the influence of the particle size distribution and the Si content on a volume of heater deformation was examined. The result will be explained as follows.

Alumina particles used for the experiment were those having a purity of 99.7 wt % and a Si content of 50 ppm, those having a purity of 99.7 wt % and a Si content of 100 ppm, those having a purity of 99.9 wt % and a Si content of 200 ppm, or those having a purity of 99.9 wt % and a Si content of 300 ppm. The alumina particles as a whole had a Na content of 20 ppm in each case.

With respect to the particle size distribution of the particles described above, the alumina particles with a particle size of 2 μm or less had a middle particle-size of about 0.5 μm (distributed mainly in a range of 0.1–1 μm) in volume distribution and the alumina particles with a particle size above 2 μm had a middle particle-size of about 10 μm (distributed mainly in a range of 5–20 μm) in volume distribution, which were mixed at a fixed ratio to be used.

Heaters having an alumina electrical insulating layer were manufactured under the following respective conditions about the Si content in alumina particles. Indirectly heated cathodes comprising the respective heaters were incorporated into cathode-ray tubes. In each cathode-ray tube, a forced heat cycle experiment was carried out by applying a voltage of about 8V (about 1.3 times of voltage at the time of practical operations) to the heater repeatedly.

Figure 8:
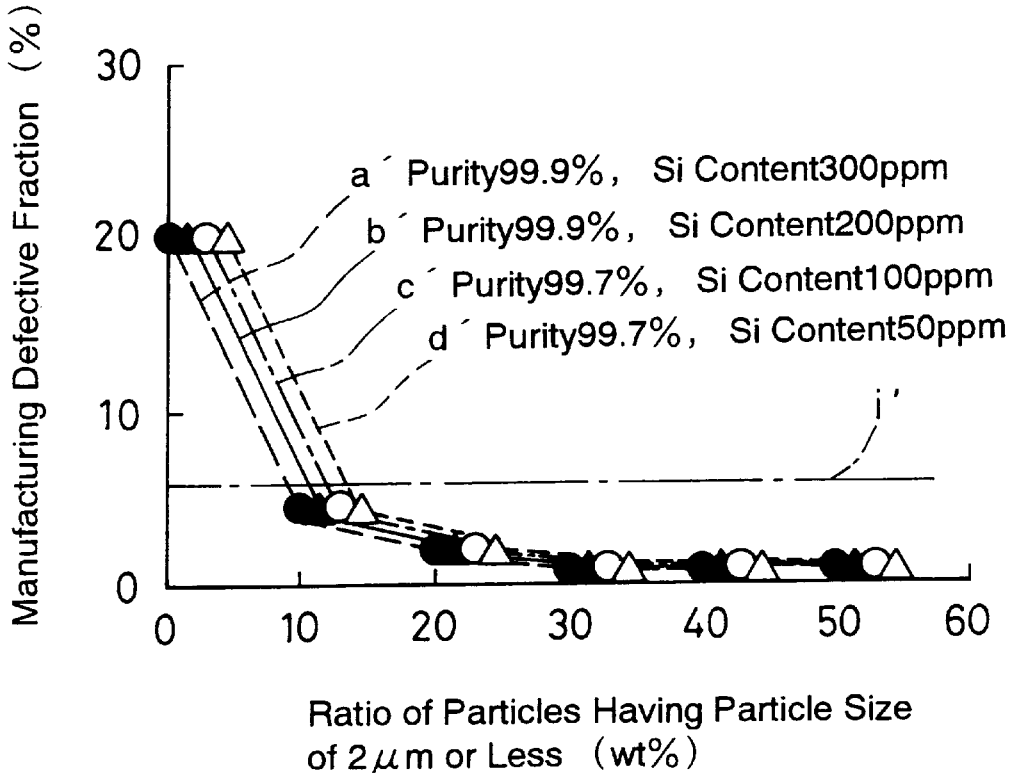
FIG. 8 is a graph showing the relationship between a manufacturing defective percentage and a ratio of alumina particles having a particle size of 2 μm or less in a second embodiment of the present invention.

FIG. 8 shows the relationship between a ratio of alumina particles with a particle size of 2 μm or less and a manufacturing defective percentage.

In FIG. 8, marks ●(a curved line a'), ▲(a curved line b'), ○(a curved line c'), and Δ(a curved line d') indicate the cases where the alumina particles have a Si content of 300 ppm, 200 ppm, 100 ppm, and 50 ppm, respectively. A straight line i' indicates a boundary line that shows a manufacturing defective percentage of 5%. The allowable range of the manufacturing defective percentage is shown below the line i'.

As shown in FIG. 8, when the ratio of minute alumina particles with a particle size of 2 μm or less contained in an alumina electrical insulating layer becomes below 10 wt % in each case described above, the formability of the alumina electrical insulating layer is deteriorated, resulting in a high manufacturing defective percentage. Thus, it was found that preferably the alumina particles with a particle size of 2 μm or less were present in a ratio of at least 10 wt %.

Figure 9:
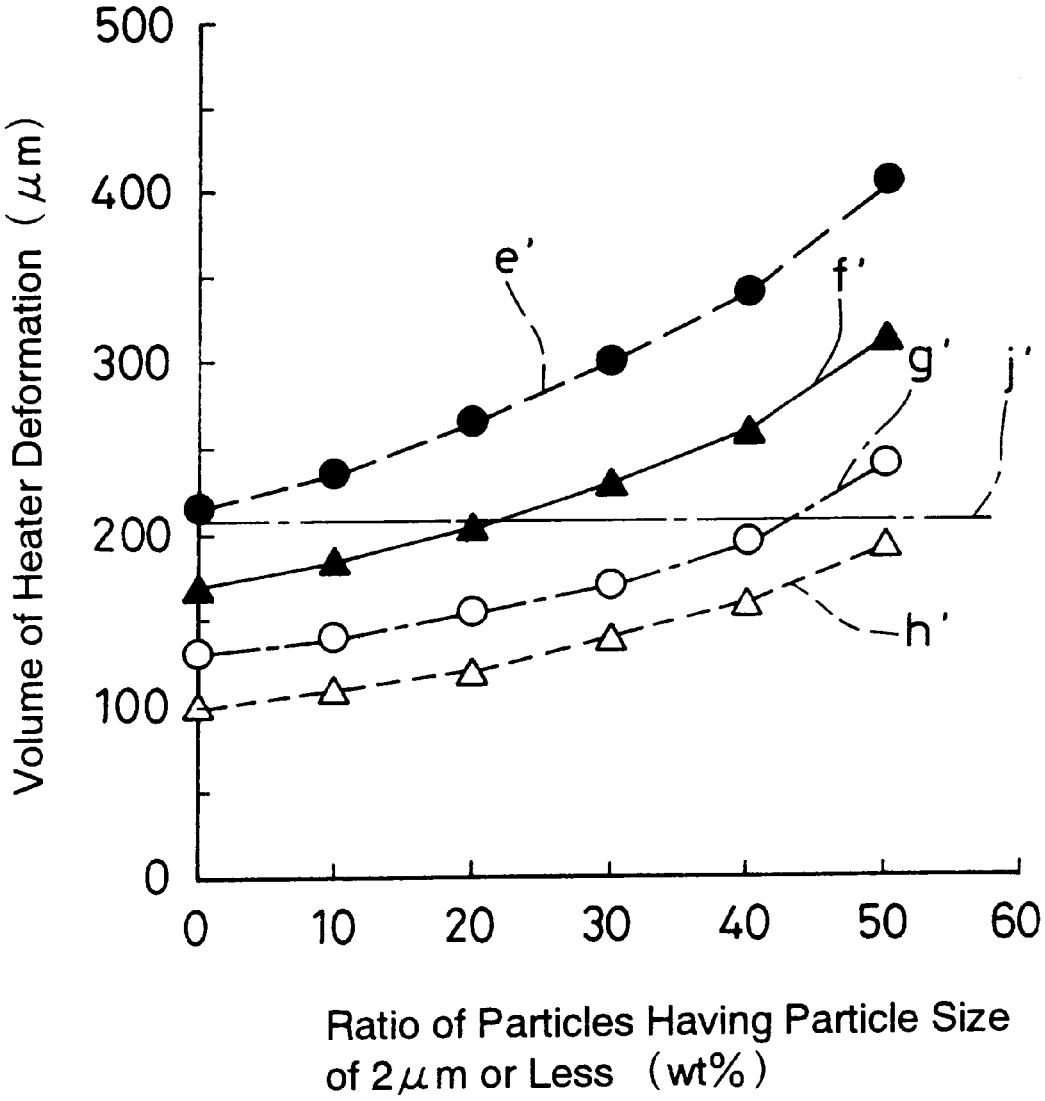
FIG. 9 is a graph showing the relationship between a volume of heater deformation and a ratio of alumina particles having a particle size of 2 μm or less in the second embodiment of the present invention.

FIG. 9 shows the relationship between a ratio of alumina particles with a particle size of 2 μm or less and a volume of heater deformation (a volume 15 of heater deformation in FIG. 9). Marks ●(a curved line e'), ▲(a curved line f'), ○(a curved line g'), and Δ(a curved line h') show the experimental results under the same conditions as those for the respective marks in FIG. 7. A straight line j' indicates a boundary line that shows a volume of heater deformation of 200 μm. When the deformation volume is shown above the line j', it indicates "defective".

As shown with the curved lines e'–h' in FIG. 9, when the alumina particles have a Si content of 100 ppm or less, the volume of heater deformation is small and therefore good results can be obtained. When the alumina particles have a purity of at least 99.7 wt %, almost the same effect can be obtained regardless of the purity. That is to say, the effect varies greatly depending on the Si content. However, when the ratio of the alumina particles with a particle size of 2 μm or less goes beyond 40 wt %, the volume of heater deformation reaches to the defective level (a level affecting the characteristics of a cathode-ray tube). Thus, it was found that in view of decreasing the volume of heater deformation, preferably the alumina particles had a Si content of 100 ppm or less and were present in a ratio of 40 wt % or less.

For reference, a typical purity of alumina particles and typical impurities in the alumina particles under the conditions on which the best result was obtained in the above-mentioned experiment are shown in Table 1. Particularly, the alumina particles contain small amounts of Mg, Ca, Fe, and the like besides Na and Si. The contents of Mg, Ca, Fe, and the like are not limited to the values shown in Table 1. However, it is preferable that each content is in a range of some ppm to several tens ppm.

TABLE 1

| Typical Purity of Alumina Particle and Impurities | |
|---|---|
| Purity of Alumina | 99.7% |
| Whole Na Content | 20 ppm |
| Whole Si Content | 50 ppm |
| Whole Mg Content | 8 ppm |
| Whole Ca Content | 10 ppm |
| Whole Fe Content | 10 ppm |

According to the experimental results described above, it was found that in an alumina electrical insulating layer of an impregnated cathode, preferably the alumina particles had a Si content of 100 ppm or less and the alumina particles with a particle size of 2 μm or less were present in a ratio of 10–40 wt %.

In addition, the composition of the alumina particles used in the case where the volume of heater deformation was in a good level and the manufacturing defective percentage was within 5% (within the allowable range in manufacturing) was examined. The alumina particles with a particle size of 5–20 μm were present in the alumina electrical insulating layer in a ratio of 40–70 wt % and the alumina particles with a particle size above 20 μm were present in a ratio of 10 wt % or less.

According to the experimental results described above, it was found that in the alumina electrical insulating layer of an impregnated cathode, preferably the Si content as a whole in alumina particles was 100 ppm or less, the alumina particles with a particle size of 2 μm or less were present in a ratio of 10–40 wt %, the alumina particles with a particle size of 5–20 μm were present in a ratio of 40–70 wt % and the alumina particles with a particle size above 20 μm were present in a ratio of 10 wt % or less.

In this embodiment, an impregnated cathode material was used for the electron-emitting part. However, the same result can be obtained when an oxide cathode material is used for the electron-emitting part. Especially in this case, it is more preferable that the alumina particles with a particle size of 2 μm or less are present in a ratio of 10–50 wt %.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An indirectly heated cathode comprising a heater having an alumina electrical insulating layer formed by layering and sintering alumina particles on a surface of a metal wire and an electron-emitting part that receives heat from the heater and emits thermoelectrons, wherein the alumina particles contained in the alumina electrical insulating layer have a purity of at least 99.7 wt % and alumina particles with a particle size of 2 μm or less included in the alumina particles used for forming the alumina electrical insulating layer have a Na content of 20 ppm or less, and wherein the alumina particles with a particle size of 2 μm or less arc present in the alumina particles as a whole in a ratio of 10–50 wt %.

2. The indirectly heated cathode according to claim 1, wherein the electron-emitting part is made of an oxide cathode material.

3. The indirectly heated cathode according to claim 1, wherein the alumina particles as a whole used for forming the alumina electrical insulating layer include alumina particles with a particle size of 2 μm or less in a ratio of 10–40 wt %, those with a particle size of 5–20 μm in a ratio of 40–70 wt %, and those with a particle size above 20 μm in a ratio of 10 wt % or less.

4. The indirectly heated cathode according to claim 1, wherein the electron-emitting part is made of an impregnated cathode material.

5. The indirectly heated cathode according to claim 1, wherein the alumina particles contained in the electrical insulating layer have a Na content of 20 ppm or less.

6. The indirectly heated cathode according to claim 1, wherein the alumina particles contained in the electrical insulating layer have a Si content of 100 ppm or less.

7. A cathode-ray tube comprising:

a face plate having a phosphor screen on its inner surface;

a funnel portion connected to the rear of the face plate; and a neck portion formed at the rear of the funnel portion, the neck portion having an electron gun that emits electron beams, wherein the electron gun comprises an indirectly heated cathode comprising a heater having an alumina electrical insulating layer formed by layering and sintering alumina particles on a surface of a metal wire and an electron-emitting part that receives heat from the heater and emits thermoelectrons, and the alumina particles contained in the alumina electrical insulating layer have a purity of at least 99.7 wt % and alumina particles with a particle size of 2 μm or less included in the alumina particles used for forming the alumina electrical insulating layer have a Na content of 20 ppm or less, and wherein the alumina particles with a particle size of 2 μm or less are present in the alumina particles as a whole in a ratio of 10–50 wt %.

8. The cathode-ray tube according to claim 7, wherein the electron-emitting part is made of an oxide cathode material.

9. The cathode-ray tube according to claim 7, wherein the alumina particles contained in the whole alumina electrical insulating layer include alumina particles with a particle size of 2 μm or less in a ratio of 10–40 wt %, those with a particle size of 5–20 μm in a ratio of 40–70 wt %, and those with a particle size above 20 μm in a ratio of 10 wt % or less.

10. The cathode-ray tube according to claim 7, wherein the electron-emitting part is made of an impregnated cathode material.

11. The cathode-ray tube according to claim 7, wherein the alumina particles contained in the whole electrical insulating layer have a Na content of 20 ppm or less.

12. The cathode-ray tube according to claim 7, wherein the alumina particles contained in the whole electrical insulating layer have a Si content of 100 ppm or less.

13. An indirectly heated cathode comprising a heater having an alumina electrical insulating layer formed by layering and sintering alumina particles on a surface of a metal wire and an electron-emitting part that receives heat from the heater and emits thermoelectrons, wherein the alumina particles contained in the alumina electrical insulating layer have a purity of at least 99.7 wt % and the alumina particles used for forming the alumina electrical insulating layer have a Si content of 100 ppm or less, and wherein the alumina particles contained in the alumina electrical insulating layer include alumina particles with a particle size of 2 μm or less in a ratio of 10–50 wt %.

14. The indirectly heated cathode according to claim 13, wherein the electron-emitting part is made of an oxide cathode material.

15. The indirectly heated cathode according to claim 13, wherein the alumina particles contained in the whole alumina electrical insulating layer include alumina particles with a particle size of 2 μm or less in a ratio of 10–40 wt %, those with a particle size of 5–20 μm in a ratio of 40–70 wt %, and those with a particle size above 20 μm in a ratio of 10 wt % or less.

16. The indirectly heated cathode according to claim 13, wherein the electron-emitting part is made of an impregnated cathode material.

17. The indirectly heated cathode according to claim 13, wherein alumina particles contained in the whole electrical insulating layer have a Na content of 20 ppm or less.

18. The indirectly heated cathode according to claim 17, wherein alumina particles with a particle size of 2 μm or less included in the alumina particles contained in the whole alumina electrical insulating layer have a Na content of 20 ppm or less.

19. A cathode-ray tube comprising:

a face plate having a phosphor screen on its inner surface;

a funnel portion connected to the rear of the face plate; and a neck portion formed at the rear of the funnel portion, the neck portion having an electron gun that emits electron beams, wherein the electron gun comprises an indirectly heated comprising a heater having an alumina electrical insulating layer formed by layering and sintering alumina particles on a surface of a metal wire and an electron-emitting part that receives heat from the heater and emits thermoelectrons, and the alumina particles contained in the alumina electrical insulating layer have a purity of at least 99.7 wt % and the alumina particles used for forming the alumina electrical insulating layer have a Si content of 100 ppm or less, and wherein the alumina particles contained in the alumina electrical insulating layer include alumina particles with a particle size of 2 $\mu$m or less in a ratio of 10–50 wt %.

20. The cathode-ray tube according to claim 19, wherein the electron-emitting part is made of an oxide cathode material.

21. The cathode-ray tube according to claim 19, wherein the alumina particles contained in the whole alumina electrical insulating layer include alumina particles with a particle size of 2 $\mu$m or less in a ratio of 10–40 wt %, those with a particle size of 5–20 $\mu$m in a ratio of 40–70 wt %, and those with a particle size above 20 $\mu$m in a ratio of 10 wt % or less.

22. The cathode-ray tube according to claim 19, wherein the electron-emitting part is made of an impregnated cathode material.

23. The cathode-ray tube according to claim 19, wherein alumina particles contained in the whole electrical insulating layer have a Na content of 20 ppm or less.

24. The cathode-ray tube according to claim 23, wherein alumina particles with a particle size of 2 $\mu$m or less included in the alumina particles contained in the whole alumina electrical insulating layer have a Na content of 20 ppm or less.

* * * * *